United States Patent [19]

Kawai et al.

[11] Patent Number: 4,730,987

[45] Date of Patent: Mar. 15, 1988

[54] VARIABLE DELIVERY COMPRESSOR

[75] Inventors: Katsunori Kawai; Hiroyuki Deguchi; Hisao Kobayashi; Shuichi Sugizono, all of Kariya, Japan

[73] Assignee: Kabushiki Kaisha Toyoda Jidoshokki Seisakusho, Aichi, Japan

[21] Appl. No.: 910,948

[22] Filed: Sep. 24, 1986

[30] Foreign Application Priority Data

Oct. 4, 1985 [JP] Japan ..... 60-222561

[51] Int. Cl.[4] ..... F04B 1/26

[52] U.S. Cl. ..... 417/270; 417/298

[58] Field of Search ..... 417/297, 298, 269, 270

[56] References Cited

U.S. PATENT DOCUMENTS

| | | | |
|---|---|---|---|
| 2,682,227 | 6/1954 | Burris | 417/298 |
| 3,000,319 | 9/1961 | Tuck | 417/270 |
| 3,552,886 | 1/1971 | Olson | 417/269 |
| 4,389,168 | 6/1983 | Yannascoli | 417/298 |
| 4,403,921 | 9/1983 | Kato | 417/297 |
| 4,547,133 | 10/1985 | Nishizawa | 417/297 |

FOREIGN PATENT DOCUMENTS

| | | | |
|---|---|---|---|
| 2444474 | 9/1980 | France | 417/298 |
| 174870 | 5/1983 | Japan | 417/270 |

*Primary Examiner*—William L. Freeh

*Attorney, Agent, or Firm*—Burgess, Ryan and Wayne

[57] ABSTRACT

A variable delivery compressor containing a plurality of compression chambers and reciprocatory compression pistons is adapted for use in an air-conditioning circuit of a vehicle. The compressor has a suction chamber communicating with the compression chambers by way of a plurality of suction valves, some of which are capable of being deformed by a valve pressing mechanism from a first position, where the refrigerant is compressed, to a second position where the compression of the refrigerant is partially ineffective. The valve pressing mechanism contains an axially movable spool actuated by an actuating unit controlled by a cooling-load responsive control unit.

10 Claims, 8 Drawing Figures

VARIABLE DELIVERY COMPRESSOR

BACKGROUND OF THE INVENTION

1. Field of the Invention

The present invention relates to a variable delivery compressor with reciprocatory pistons, adapted mainly for use in an air conditioning system of a vehicle.

2. Description of the Related Art

Many types of variable delivery compressors are known, such as a typical variable compressor with reciprocatory double-acting pistons disclosed in U.S. Pat. No. 4,403,921 to Kato et al. This variable delivery compressor is provided with a delivery valve capable of moving between a first full delivery position and a second reduced delivery position in response to a change in a cooling load requirement, and a valve is arranged adjacent to a delivery flange to prevent the compressed refrigerant from being circulated within the compressor per se when the compressor is operated at a reduced delivery state. The delivery valve comprises a valve member and a spool member having a front end face to which the valve member is fixed, and a rear end face formed as a pressure receiving surface. The spool member is slidable so that the valve member can move from the first full delivery position to the second reduced delivery position, and vice versa. The above-mentioned valve member is formed as a check valve.

In the above-mentioned variable delivery compressor, because the check valve is employed, a problem arises in that the refrigerant delivery mechanism of the compressor becomes complicated. Further, since the delivery flange of the compressor must receive the check valve, the size of the delivery flange must be such that it is difficult to find a space for mounting a compressor having such a delivery flange in a small engine compartment of a vehicle.

Also, when the operation of the compressor is switched from full delivery to reduced delivery, a part of the compressed refrigerant under a high temperature and high pressure is temporarily returned directly from the delivery side of the compressor to the suction side thereof, and as a result, the compression efficiency is reduced. In addition, during the reduced delivery operation of the compressor, while some compression chambers, i.e., the compression chambers on the axially rear side of the compressor, are supplied with the refrigerant gas to be conpressed through both suction and discharge ports of the valve plate of the compressor, the delivery of the refrigerant due to compressive action of the pistons is permitted to pass through only the discharge port. As a result, it is impossible to evacuate all of the refrigerant gas from the compression chambers on the rear side. Therefore, an excessive load is applied to the vehicle engine when driving the compressor, and consequently, a loss of power of the vehicle engine cannot be avoided at a high speed driving condition of the vehicle.

SUMMARY OF THE INVENTION

An object of the present invention is therefore to eliminate the above-mentioned problems encountered by the conventional variable delivery compressor with double-acting reciprocatory pistons for compression.

Another object of the present invention is to provide a variable delivery compressor with an improved mechanism for varying a cooling capacity thereof in response to a change in the cooling load.

A further object of the present invention is to provide a variable delivery air-conditioning compressor having a novel mechanism for smoothly switching the cooling capacity thereof from a full delivery condition to a reduced delivery condition, and vice versa, in response to a change in the cooling load of the air-conditioning system.

In accordance with the present invention, there is provided a variable delivery compressor adapted for use in compressing a refrigerant gas of an air-conditioning circuit of a vehicle. The compressor includes a cylinder block unit having therein a plurality of compression chambers in which reciprocatory compression pistons are received, respectively; a housing unit having therein a suction chamber from which refrigerant gas before compression is sucked into the plurality of compression chambers and a delivery chamber into which compressed refrigerant gas is delivered from the compression chambers; valve plates arranged between the cylinder block unit and the housing unit, and having therein suction ports providing a fluid communication between respective compression chambers and the suction chamber, and delivery ports providing a fluid communication between respective compression chambers and the delivery chamber; a suction flange element attached to the cylinder block unit, for introducing the refrigerant gas before compression from the air-conditioning circuit into the suction chamber; a delivery flange element attached to the cylinder block, for delivering the compressed refrigerant gas from the delivery chamber to the air-conditioning circuit; delivery valves closing the delivery ports that provide a fluid communication between the plurality of compression chambers and the delivery chamber, the delivery valves being opened by the compressed refrigerant gas delivered from the compression chambers into the delivery chamber; suction valves closing the suction ports that provide a fluid communication between the plurality of compression chambers and the suction chamber, and capable of being opened by the refrigerant gas sucked from the suction chamber into respective compression chambers; a movable unit arranged in the suction chamber and capable of moving toward and away from the suction valves; a valve pressure unit held by the movable unit so as to be moved together with the movable unit and capable of forcibly opening a predetermined number suction valves among the suction valves when moved toward the suction valves, the valve pressing unit or the movable unit being provided with a function such that the predetermined suction valves forcibly opened by the valve pressing unit may be closed in response to movement of the compression pistons toward the top dead centers thereof; a control unit for providing a control signal indicative of a change in a cooling load; and, an actuating unit for actuating movement of the movable unit toward and away from the suction valves in response to a control signal from the control unit.

BRIEF DESCRIPTION OF THE DRAWINGS

The above and other objects, features, and advantages of present invention will become apparent from the ensuing description of the embodiments illustrated in the accompanying drawings wherein.

DESCRIPTION OF THE PREFERRED EMBODIMENTS

Figure 1:
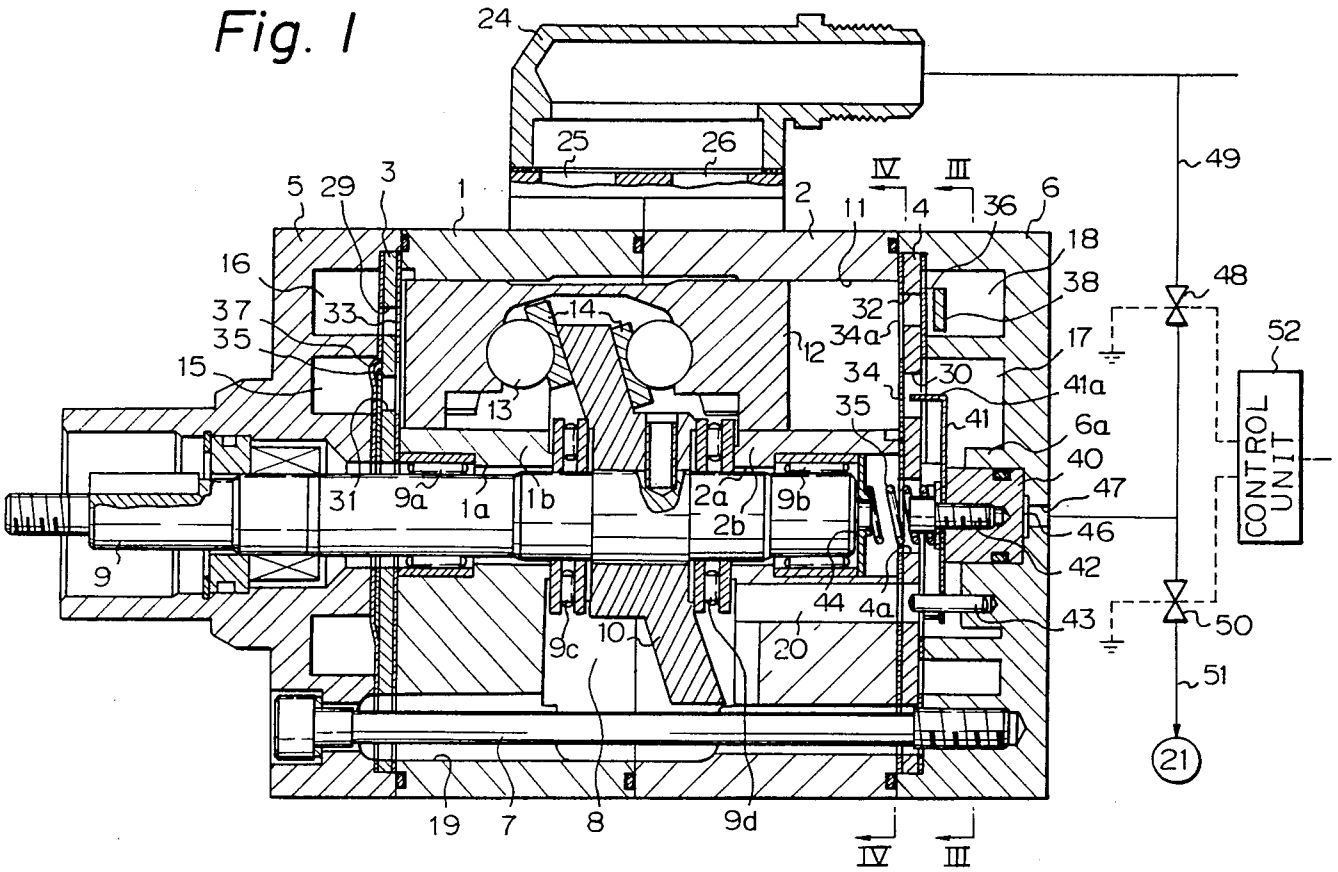
FIG. 1 is a vertical section of a swash plate type compressor, as an example of a variable delivery compressor, according to a first embodiment of the present invention, illustrating one operating state of the compressor.
Figure 2:
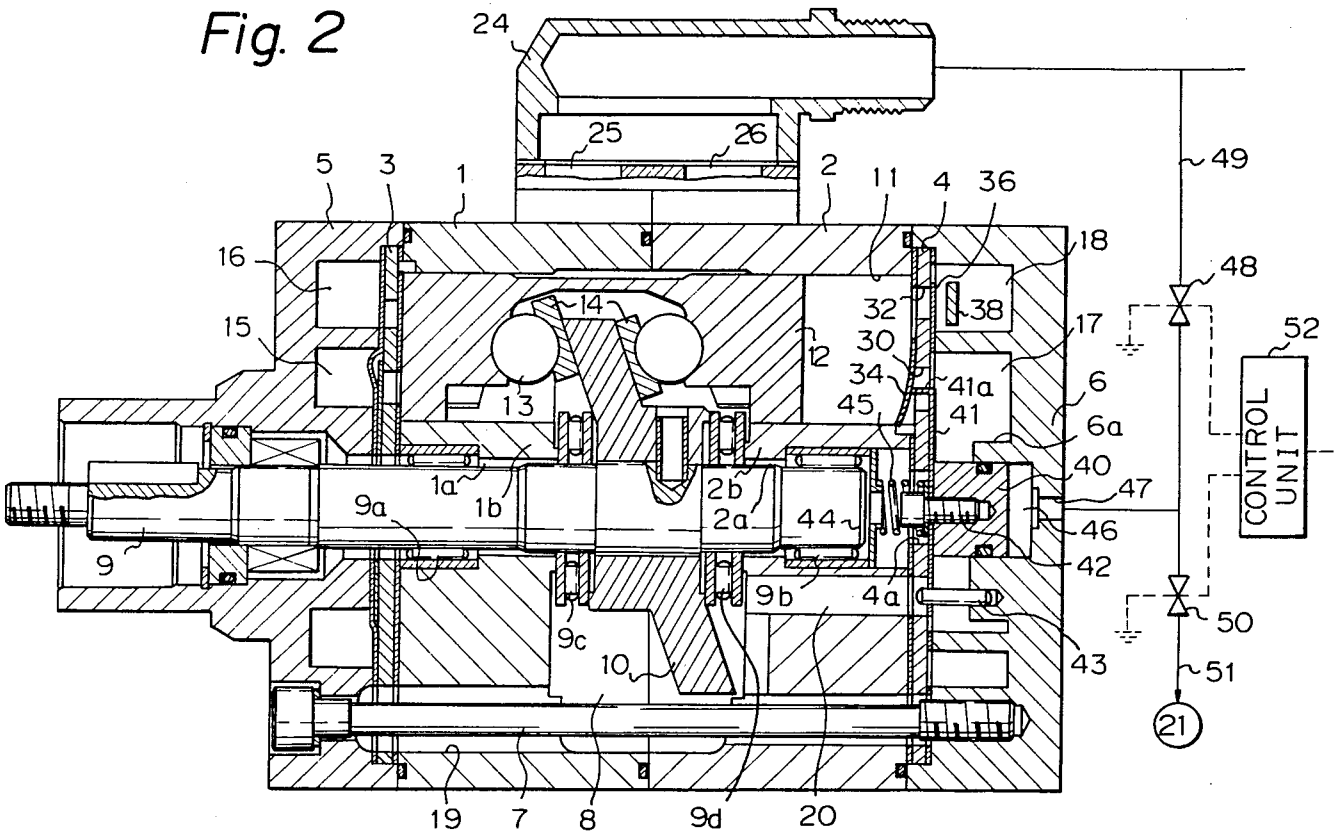
FIG. 2 shows the same vertical section of the compressor of FIG. 1, but illustrates another operation state of the compressor.
Figure 3:
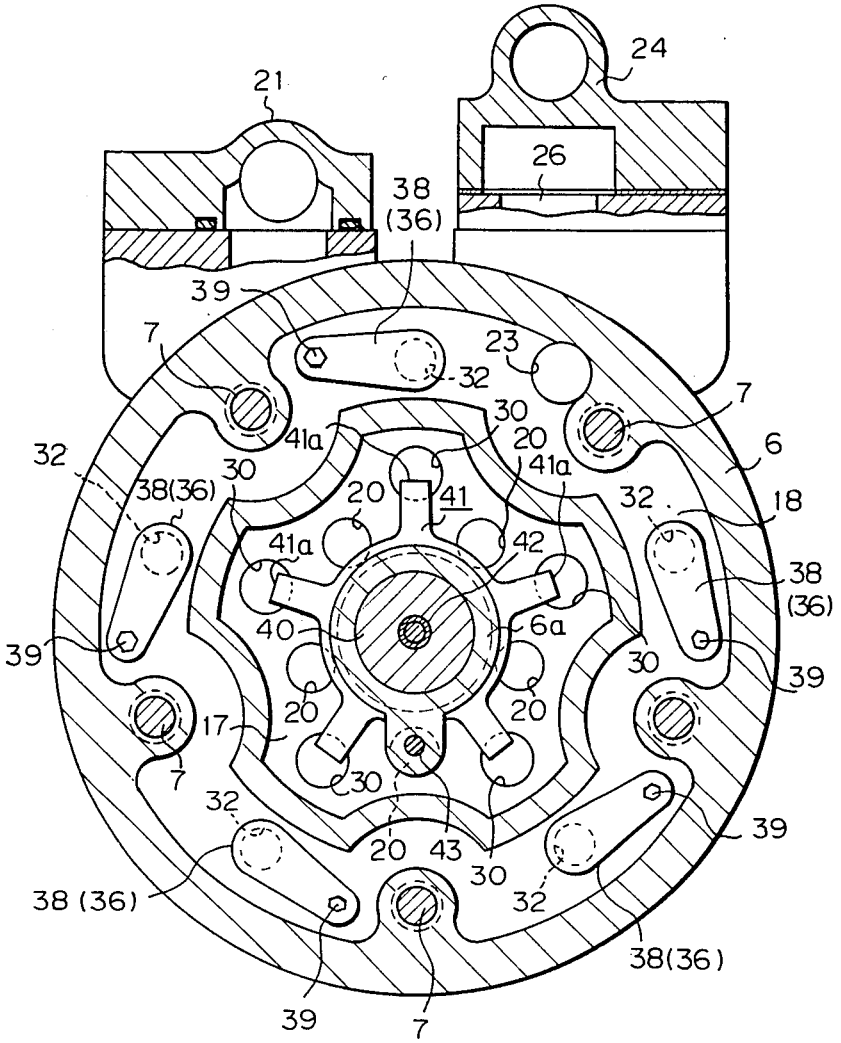
FIG. 3 is a section taken along the line III—III of FIG. 1.
Figure 4:
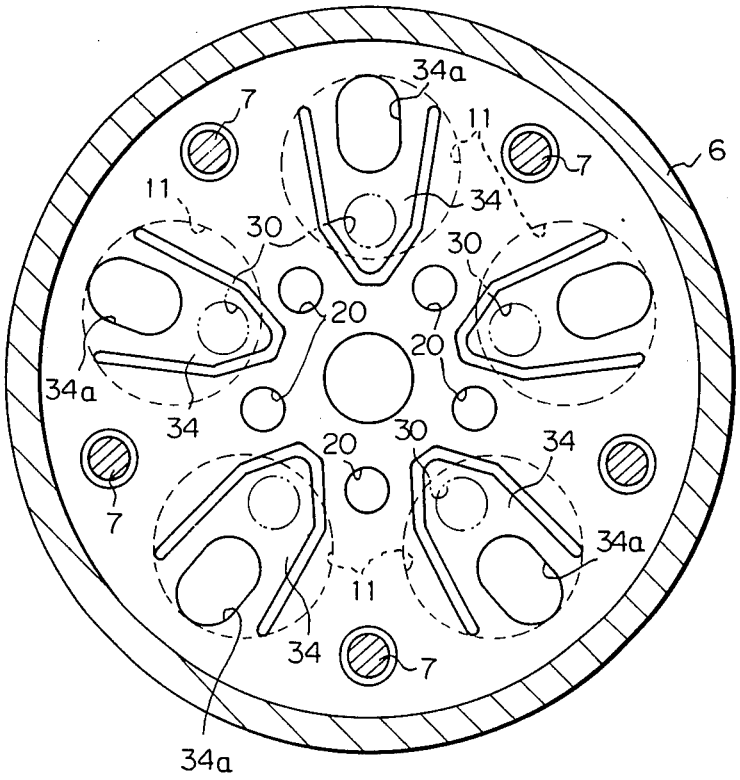
FIG. 4 is a section taken along the line IV—IV of FIG. 1.
Figure 5:
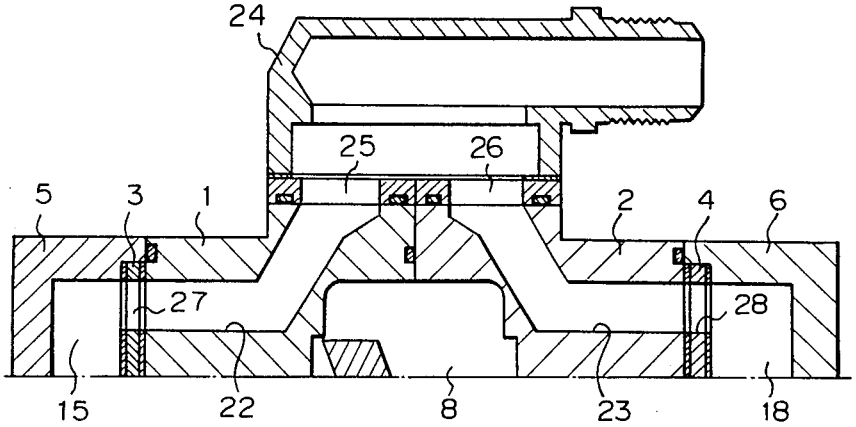
FIG. 5 is a partial vertical section of the compressor of FIG. 1, illustrating delivery passages for the compressed refrigerant gas, and a delivery flange of the compressor of FIG. 1.

FIGS. 1 through 6 illustrate the first embodiment of a double-acting swash plate type compressor having ten cylinder bores, five on each side. The compressor has axially connected cylinder blocks 1 and 2 combined to form a cylinder block. The front and rear ends of the combined cylinder block are closed by front and rear housings 5 and 6, via valve plates 3 and 4, respectively. The two cylinder blocks 1 and 2, the two housings 5 and 6, and the two valve plates 3 and 4 are connected together by an appropriate number of screw bolts 7. At the connecting portion of the front and rear cylinder blocks 1 and 2, a swash plate chamber 8 is formed in which a swash plate 10 secured to a drive shaft 9 is received. The drive shaft 9 axially extends through shaft bores 1*a* and 2*a* which are bored through the center of the connected cylinder blocks 1 and 2. The two cylinder blocks 1 and 2 have boss portions 1*b* and 2*b*, respectively, in which anti-friction radial bearings 9*a* and 9*b* for rotatably supporting the drive shaft 9 are fitted respectively. Thrust bearings 9*c* and 9*d* are interposed between the above-mentioned boss portions 1*b* and 2*b* and the swash plate 10, respectively. Each of the cylinder blocks 1 and 2 is formed with five cylinder bores 11 provided as compression chambers extending in parallel with the drive shaft 9 and arranged at five radial positions around the drive shaft 9. The five cylinder bores 11 of the front cylinder block 1 are respectively aligned with the five cylinder bores 11 of the rear cylinder block 2. Double-acting pistons 12 fitted in the cylinder bores 11 are engaged with the swash plate 10 via ball bearings 13 and shoes 14. Due to this engagement, rotation of the swash plate 10 causes a reciprocal movement of the pistons 12 within the cylinder bores 11. Within the front housing 5 are formed an annular delivery chamber 15 arranged in the central portion thereof, and an outer suction chamber 16 annularly encircling the delivery chamber 15. Within the rear housing 6 are formed a suction chamber 17 arranged in the central portion of the rear housing 6, and an outer delivery chamber 18 annularly surrounding the suction chamber 17. The suction chamber 17 of the rear housing 6 has the shape of a substantially round recessed chamber having a central cylindrical pressure chamber 46 described hereinafter. The suction chamber 16 of the front housing 5 is connected to the swash plate chamber 8 by suction passages 19 which also act as through-holes through which the afore-mentioned screw bolts 7 are axially extended. The suction chamber 17 of the rear housing 6 is also connected to the swash plate chamber 8 by a plurality (five) of suction passages 20 which are arranged so as to extend through the valve plate 4 and each portion of the rear cylinder block 2 between two neighbouring cylinder bores 11. The swash plate chamber 8 per se is fluidly connected to a suction flange 21 (FIG. 3) which is attached to the outer surface of the connecting portion of the cylinder blocks 1 and 2. Delivery passages 22 and 23 (FIG. 5) are formed in one of the five positions arranged between the neighbouring cylinder bores 11 of the combined cylinder blocks 1 and 2. The delivery passage 22 extends from the surface of the cylinder block 1 which is in contact with the valve plate 3, toward the connecting portion of the cylinder blocks 1 and 2, while the delivery passage 23 extends from the surface of the cylinder block 2 in contact with the valve plate 4 toward the connecting portion of the cylinder blocks 1 and 2. The two delivery passages 22 and 23 are respectively and fluidly connected to a delivery flange 24 attached to the outer surface of the connecting portion of the cylinder blocks 1 and 2, via connecting passages 25 and 26, respectively. The two delivery passages 22 and 23 are also fluidly connected to the delivery chambers 15 and 18, respectively, via connecting bores 27 and 28 formed in the valve plates 3 and 4, respectively. It should be noted that a part of the delivery chamber 15 on the front side is outwardly expanded so as to be readily connected to the delivery passage 22. The front and rear valve plates 3 and 4 are respectively bored with suction ports 29 and 30 for connecting the cylinder bores 11 and the suction chambers 16 and 17, respectively, and delivery ports 31 and 32 for connecting the cylinder bores 11 and the delivery chambers 15 and 18, respectively. The suction ports 29 and 30 are provided with deformable suction valves 33 and 34, respectively, arranged on the faces of the front and rear valve plates 3 and 4 facing the ends of the front and rear cylinder blocks 1 and 2, and the delivery ports 31 and 32 are provided with deformable delivery valves 35 and 36, respectively, arranged on the faces of the front and rear valve plates 3 and 4 facing the front and rear housings 5 and 6. Each of the suction valves 34 on the rear side is formed as a flexible reed valve, as illustrated in FIG. 4, and is bored, at a base portion thereof, with a through-hole 34*a* confronting each of the afore-mentioned delivery ports 32 of the rear valve plate 4. The amount of deformation of the delivery valves 35 and 36 is restricted within respective given limits by valve guards 37 and 38, respectively. The front delivery valve 35 and the valve guard 37 are fixed between the front valve plate 3 and the front housing 5. The rear delivery valves 36 and the associated valve guards 38 are fixed to the rear valve plate 4 by screw bolts 39, as illustrated in FIG. 3.

In the suction chamber 17 on the rear side, a control mechanism is provided for varying the delivery of the compressor. The control mechanism can operate to forcibly move or deform the rear suction valves 34 from a first position where the suction valves 34 permit the pistons 12 to carry out the compression of the refrigerant gas drawn into the cylinder bores 11 of the rear cylinder block 2, i.e., the compression chambers of the rear cylinder block 2 during the compression stroke of the pistons 12 to a second position where, because of the rear suction valves 34, the pistons 12 are unable to carry out the compression of the refrigerant gas drawn into the compression chambers of the rear cylinder block 2. That is, when the rear suction valves 34 formed as reed valves are deformed to the above-mentioned second position, they are moved away from the suction ports 30 of the valve plate 4 into the cylinder bores 11 of the rear cylinder block 2. Therefore, the suction ports 30 are left open not only during the suction stroke of the pistons 12 but also during the compression stroke of the pistons 12. The description of the above-mentioned control mechanism will be provided in more detail.

In the rear housing 6, there is formed an inwardly projecting wall 6*a* having a cylindrical wall defining therein the afore-mentioned pressure chamber 46 in which a spool 40 is axially slidably received as a movable unit. That is, the spool 40 can move toward and away from the rear valve plate 4. A valve pressing plate 41 formed as a valve pressing unit is attached to a front end of the spool 40 by a screw bolt 42. The valve pressing plate 41 is provided with a plurality (five) of radial valve pressing tongues 41*a* which are formed as one part with the plate 41 and project from the periphery of the valve pressing plate 41 toward respective suction ports 30 so as to be able to press against and deform the suction valves 34. The valve pressing plate 41 is made of a resilient material, such as a stainless steel plate, so that it may be elastically bent toward and away from the rear valve plate 4. As a result, the valve pressing plate 41 has a function such that the elastic deformation of the valve pressing plate 41 permits the valve pressing tongues 41*a* moved to the position as shown in FIG. 2, where the suction valves 34 are deformed to the second position, to be elastically moved back to the position where the suction valves 34 are returned to the first position closing the rear suction ports 30 by the movement of the pistons 12 toward the top dead center thereof within the cylinder bores 11 of the rear cylinder block 2. The operation of the resilient valve pressing plate 41 as well as the valve pressing tongues 41*a* will be further described later.

A positioning pin 43 is fixed to the rear housing 6. The positioning pin 43 permits the valve pressing plate 41 fixed to the spool 40 to move forward and back, and prevents these elements 40 and 41 from being rotated.

The rear valve plate 4 is formed with a central bore 4*a* which connects the shaft bore 2*a* to the suction chamber 17 and permits the head of the screw bolt 42 to pass therethrough when the spool 40 moves toward the rear valve plate 4. A coil spring 45 is disposed between the spool 40 and a spring seat 44 positioned adjacent to a rear end of the drive shaft 9. The coil spring 45 always urges the spool 40 and the valve pressing plate 41 to be moved apart from the rear valve plate 4 and the suction valves 34, respectively. The pressure chamber 46 of the rear housing 6 is provided for receiving a pressure applied to the rear face of the spool 40. The pressure may be selected as either a high delivery pressure or a low suction pressure. The selection of the application of a high delivery or low suction pressure is determined by a control unit 52. A pressure inlet hole 47 formed at the central portion of the rear housing 6 introduces the high delivery and the low suction pressures into the pressure chamber 46. The pressure inlet hole 47 can communicate with the delivery flange 24 by way of a high pressure conduit 49 having therein a first solenoid valve 48, and also can communicate with the suction flange 21 by a low pressure conduit 51 having therein a second solenoid valve 50. The first and second solenoid valves 48 and 50 are respectively connected to the control unit 52 which, in turn, is connected to a temperature sensor (not illustrated in FIGS. 1 through 6) measuring a temperature at an outlet of an evaporator of the air-conditioning circuit. It should be understood that the temperature at the outlet of the evaporator changes in response to a change in a cooling load of the air-conditioning circuit. It should be also understood that the control unit 52 includes therein a temperature comparing circuit (not illustrated in FIGS. 1 through 6) which compares the temperature measured by the above-mentioned temperature sensor with predetermined reference low and high temperatures, e.g., 5° C. and 10° C. That is, when the control unit 52 detects that the temperature at the outlet of the evaporator has reached the low reference temperature (5° C.), the unit 52 generates a command signal to open the second solenoid valve 50 and to close the first solenoid valve 48, so that the delivery of the compressor is increased. On the other hand, when the control unit 52 detects that the temperature at the outlet of the evaporator has reached the high reference temperature (10° C.), the unit 52 generates another command signal to open the first solenoid valve 48 and close the second solenoid valve 50, so that the delivery of the compressor is reduced.

The operation of the swash plate type compressor according to the first embodiment of the present invention will now be described hereinbelow.

Figure 6:
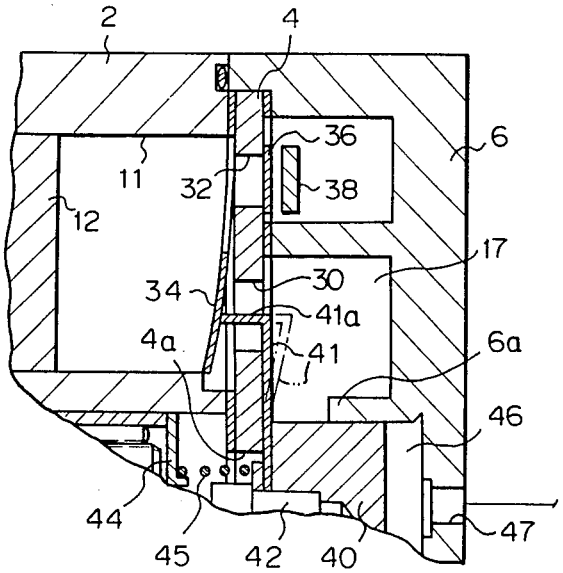
FIG. 6 is a partial enlarged view of a part of the compressor of FIG. 1.

When the cooling load of the air-conditioning circuit is large, the control unit 52 generates a command signal indicating that the delivery of the compressor should be increased. Thus, the first solenoid valve 48 is closed, and the second solenoid valve 50 is opened. As a result, the suction pressure (low pressure) is introduced into the pressure chamber 46 through the pressure inlet hole 47 from the low pressure conduit 51. Therefore, the spool 40 together with the valve pressing plate 41 are moved away from the suction valves 34 by the force of the coil spring 45. FIG. 1 illustrates the spool 40 and the valve pressing plate 41 which are moved away from the suction valves 34. Thus, the suction valves 34 are maintained at the first position to close the suction ports 30 of the rear valve plate 4. Therefore, compression of the refrigerant gas effectively takes place in all of the cylinder bores 11 of the front and rear cylinder blocks 1 and 2 by the cooperation of the reciprocating pistons 12. That is, a full delivery operation of the compressor is carried out. During the continuation of the full delivery operation of the compressor for a given time period, the cooling load in the air-conditioning circuit, i.e., in the vehicle passenger compartment, is gradually decreased. As a result, the control unit 52 generates a command signal indicating that the delivery of the compressor should be reduced. Thus, the first solenoid valve 48 is opened and the second solenoid valve 50 is closed. Therefore, the delivery pressure (high pressure) is introduced into the pressure chamber 46 from the high pressure conduit 49 through the pressure inlet hole 47. The spool 40 and the valve pressing plate 41 are now moved toward the suction valves 34 by the high delivery pressure against the total force of the coil spring 45 and the suction pressure prevailing in the suction chamber 17. Thus, the suction valves 34 on the rear side are pressed against and deformed by the valve pressing tongues 41*a* into the cylinder bores 11 on the rear side. That is, the suction valves 34 are separated from the rear valve plate 4 as shown in FIGS. 2 and 6. Consequently, the suction valves 34 cannot close the suction ports 30, and the compression of the refrigerant gas by the pistons 12 does not take place within the cylinder bores 11 on the rear side of the compressor. That is, a reduced delivery operation is carried out on the front side of the compressor.

During the reduced delivery operation of the compressor, when the pistons 12 come to the top dead center thereof within the cylinder bores 11 on the rear side, the deformed suction valves 34 (see FIG. 6) are pressed against the rear valve plate 4 by the pistons 12. Then, the valve pressing tongues 41*a* are displaced in the rearward direction by the elastic deformation of the valve pressing plate 41.

When the compressor is carrying out a reduced delivery operation, if the cooling load of the air-conditioning circuit is increased, the control unit 52 generates a command signal indicating that the delivery of the compressor should be increased, and the cylinder blocks 11 on the rear side of the compressor are switched from the state shown in FIG. 2 to the state shown in FIG. 1. That is, the operation of the compressor is changed from a reduced delivery operation to a full delivery operation.

From the foregoing description of the first embodiment, it will be understood that the operation of the compressor is switched from the full delivery operation to the reduced delivery operation, and vice versa, due to the movement of the movable unit (spool 40) and the valve pressing plate 41 having the valve pressing tongues 41*a* engageable with the suction valves 34. It will be also understood that the movement of the movable unit 40 and the valve pressing unit 41 is actuated by the operation of the two solenoid valves 48 and 50, which, in turn, are controlled by the control unit 52.

Figure 7:
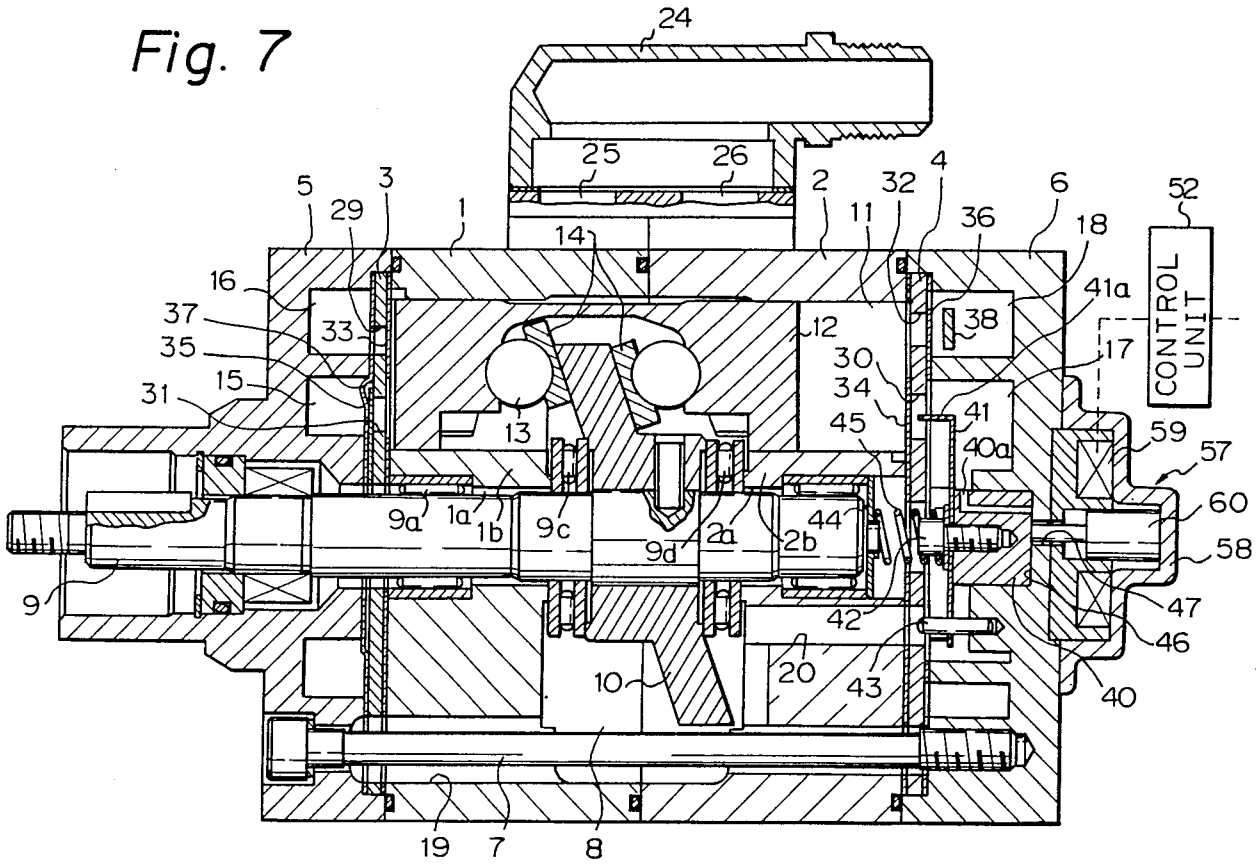
FIG. 7 is a vertical section of a swash plate type compressor according to a second embodiment of the present invention, illustrating the same operating state as shown for the compressor of FIG. 1; and, FIG. 8 is a vertical section of a swash plate type compressor according to a third embodiment of the present invention, illustrating the same operating state as shown for the compressor of FIG. 1.

Referring to FIG. 7 illustrating the swash plate type compressor according to the second embodiment of the present invention, this compressor is different from that of the first embodiment in that the movement of the spool 40 is actuated by an actuating unit quite different from the solenoid assembly (solenoids 48 and 50) of the first embodiment. At this stage, it should be understood that in the second embodiment of FIG. 7, the same reference numerals as those in FIGS. 1 through 6 designate the same or like elements as those in the first embodiment.

As illustrated in FIG. 7, the spool 40 is formed with a connecting passage 40*a* which communicates the rear suction chamber 17 with the pressure chamber 46 of the rear housing 6. A solenoid plunger 57 including a casing 58, windings 59 housed in the casing 58, and an axially movable iron core 60 arranged in the center of the windings 59, is provided as an actuating unit for actuating the axial movement of the spool 40. The housing 58 of the solenoid plunger 57 is attached to the outer face of the rear housing 6 of the compressor. An inner end of the iron core 60 of the solenoid plunger 57 extends through the pressure inlet hole 47 and is fixedly connected to the rear end of the spool 40.

The operation of the solenoid plunger 57 is controlled by the control unit 52. That is, when the control unit 52 generates a command signal indicating that the compressor should be operated at full delivery, the solenoid plunger 57 becomes OFF. As a result, the spool 40, the valve pressing plate 41 attached to the spool 40, and the iron core 60 are pressed by the force of the coil spring 45 in the rearward direction, so that the valve pressing tongues 41*a* of the valve pressing plate 41 are separated from the suction valves 34. Therefore, a full delivery operation of the compressor takes place. On the contrary, when the solenoid plunger 57 is energized and becomes ON, in response to the command signal of the control unit 52 indicating a reduced delivery operation of the compressor, the spool 40 together with the valve pressing plate 41 having the valve pressing tongues 41*a* are moved forward by the iron core 60 of the energized solenoid plunger 57 against the spring force of the coil spring 45 until the valve pressing tongues 41*a* engage and deform the rear suction valves 34. Consequently, a reduced delivery operation of the compressor takes place.

It will be understood from the foregoing that, since in the second embodiment of the present invention, a single solenoid plunger 57 is used as an actuating unit for causing the movement of the spool 40, the construction of the entire assembly of the compressor can be simplified.

Figure 8:
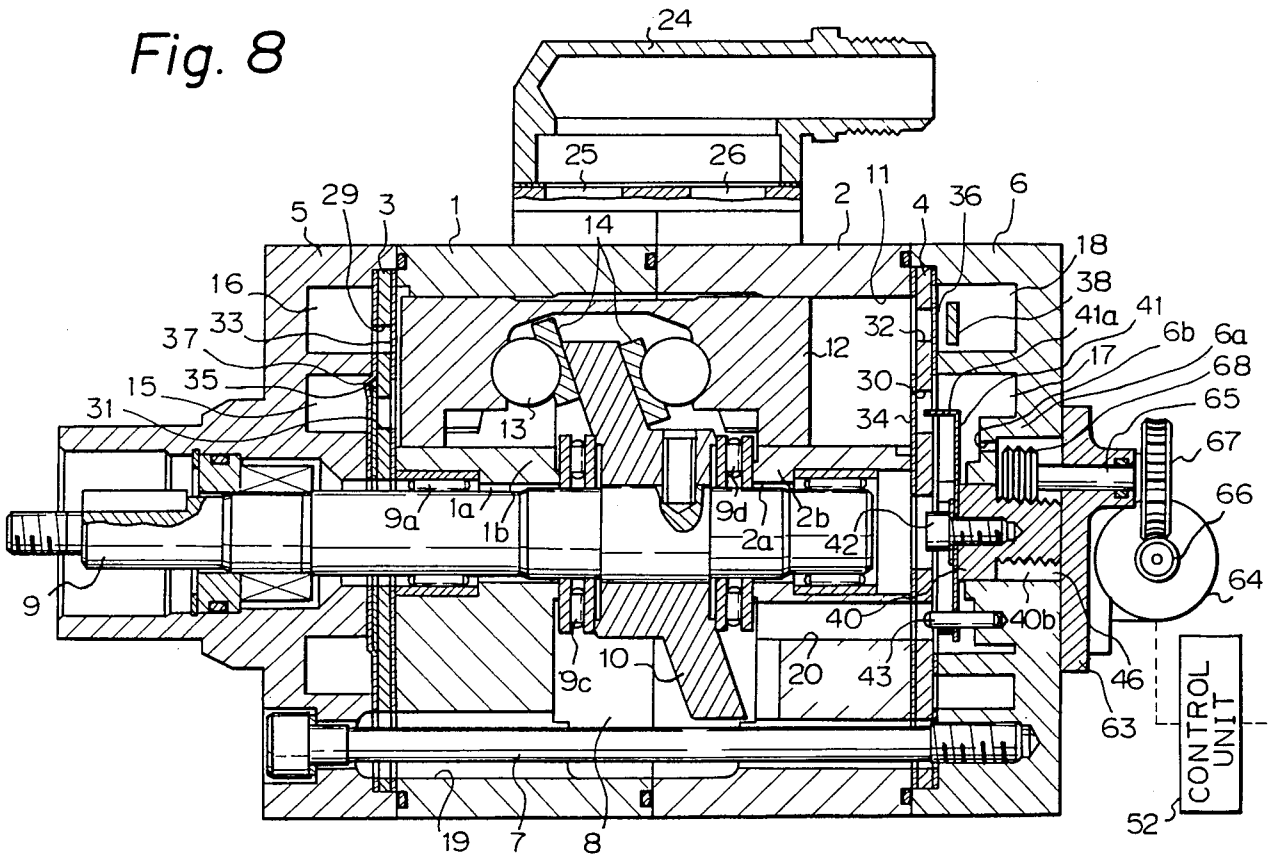

Referring to FIG. 8 illustrating the swash plate type compressor according to the third embodiment of the present invention, the compressor is further different from the first and second embodiment in that the spool actuating unit of the third embodiment is formed by the use of a worm and a screw mechanism. In FIG. 8, the same reference numerals as those in FIGS. 1 through 6 and 7 designate the same or similar elements as those in the first and second embodiments.

In FIG. 8, a mounting plate 63 is fixed to the rearmost face of the rear housing 6 for rigidly supporting a drive motor 64 which is operated in response to a command signal from the control unit 52. A rod 65 is rotatably supported in the mounting plate 63. The rod 65 is provided, at an outer end thereof, with a worm wheel 67 engaged with a worm 66 which is mounted on an output shaft of the drive motor 64. At the inner end of the rod 65, a screw element 68 is provided and engaged with screw threads 40*b* formed in the end of the spool 40. A connecting passage 6*b* is formed in the wall 6*a* defining therein the pressure chamber 46. Thus, the rear suction chamber 17 is communicated with the pressure chamber 46 by the connecting passage 6*b*. In the third embodiment of FIG. 8, a coil spring and a spring seat as used in the first and second embodiments are not employed. That is, the movement of the spool 40 is actuated by the worm and screw mechanisms which are driven by the drive motor rotatable in both the CW and CCW directions. The CW and CCW rotations of the drive motor 64 cause the CW and CCW rotations of the screw element 68 of the rod 65. Therefore, the spool 40 is moved in both the forward and backward directions. As a result, the valve pressing plate 41 having the valve pressing tongues 41*a* is moved toward and away from the rear suction valves 34. Thus, it is possible to change the operating condition of the compressor between a full delivery and a reduced delivery.

It should be understood that, in the third embodiment of FIG. 8, the above-mentioned elimination of the coil spring and spring seat can contribute to simplification of the construction of the compressor compared with the compressor of the first embodiment. It should be also understood that the employment of the spool actuating unit by the worm and screw mechanism makes it possible to finely adjust the amount of axial movement of the spool 40 in association with the rotational angle of the drive motor 64. Therefore, where the axial lengths of respective valve pressing tongues 41*a* are made different, it is possible to deform the respective rear suction valves 34 at different timings by the fine adjustment of the axial movement of the spool 40. Consequently, it is possible to change the delivery amount of the compressor in a plurality of steps i.e., more than two steps, for a reduced and a full delivery. For example, the compressor can be operated at one of 50%, 60%, 70%, 80%, 90% and 100% delivery operations.

From the foregoing description of the preferred embodiments of the present invention, it will be understood that, since the deformation of the suction valves is used for achieving the switching of the operation of the compressor from the full delivery operation to the reduced delivery operation, and vice versa, the problem of direct return of the compressed refrigerant from the delivery passage to the suction chamber that was encountered by the conventional variable delivery swash plate type compressor can be avoided. Further, since the check valve received in the delivery flange of the conventional compressor can be eliminated, the internal construction of the compressor can be simplified in comparison with the conventional compressor. Although the preferred three embodiments are disclosed hereinbefore, many variations and modifications will occur to persons skilled in the art. For example, in the first and second embodiments, the length of the five valve pressing tongues 41*a* may be made different from one another so that the switching of the operation of the compressor from the full delivery to the reduced delivery operation, and vice versa, gradually takes place. Further, the valve pressing tongues 41*a* may be constructed so that some of the five rear suction valves are deformed by the valve pressing tongues in response to the axial movement of the spool. Thus, the compressor will be operated in either the full delivery operation or the partial delivery operation other than a reduced delivery operation. Moreover, the delivery changing system as disclosed above may be also arranged on the front side of the swash plate type compressor. In addition, the above-mentioned delivery changing system may be applied to an air-conditioning compressor having compression pistons of a type different from the swash plate type compressor, such as a wobble plate type compressor and a crankshaft type compressor.

We claim:

1. A variable delivery compressor adapted for use in compressing a refrigerant gas of an air-conditioning circuit of a vehicle comprising:

cylinder block means having therein a plurality of compression chambers in which reciprocatory compression pistons are received, respectively;

housing means having therein a suction chamber from which the refrigerant gas before compression is sucked into the plurality of compression chambers and a delivery chamber into which the compressed refrigerant gas is delivered from the compression chambers;

a valve plate arranged between said cylinder block means and said housing means, and having therein suction ports providing a fluid communication between respective said compression chambers and said suction chamber and delivery ports providing a fluid communication between respective said compression chambers and said delivery chambers;

a suction flange element attached to said cylinder block means, for introducing said refrigerant gas before compression from said air-conditioning circuit into said suction chamber;

a delivery flange element attached to said cylinder block, for delivering said compressed refrigerant gas from said delivery chamber to said air-conditioning circuit;

delivery valve means for closing said delivery ports that provide a fluid communication between said plurality of compression chambers and said delivery chamber, said delivery valve means being opened by said compressed refrigerant gas when delivered from the compression chambers into said delivery chamber;

suction valve means for closing said suction ports that provide a fluid communication between said plurality of compression chambers and said suction chamber, and capable of being opened by said refrigerant gas sucked from the suction chamber into respective said compression chambers;

a spool means axially slidably mounted in a pressure chamber defined by inner wall means projected inside said housing a valve pressing plate means held by said spool means so as to be moved together with said spool means and adapted for forcibly displacing a predetermined part of said suction valve means from a first position for closing said suction ports of said valve plate to a second position for opening said suction ports when said valve pressing plate means is moved toward said suction valve means;

a plurality of valve pressing tongues projected outwardly from an outer periphery of said valve pressing plate means, each said valve pressing tongue being axially extended toward said suction valve means so as to be engaged with said suction valve means when said spool means is moved toward said suction valve means;

means for permitting said predetermined part of said suction valve means which has been forcibly opened by said valve pressing plate means and said valve pressing tongues to return to said first position from said second position in response to movement of said compression pistons toward top dead centers thereof;

a control unit for providing a control signal indicating that a change in a delivery amount of said compressor is needed in response to a change in a cooling load applied to said air-conditioning circuit, and;

an actuating means for causing movement of said spool means toward said suction valve means upon being energized by said control signal of said control unit.

2. A variable delivery compressor according to claim 1, wherein said plurality of valve pressing tongues have respective axial lengths different from one another.

3. A variable delivery compressor according to claim 1, wherein said valve pressing plate means and said valve pressing tongues are formed as one part made of elastic material, and wherein said means for permitting said predetermined part of said suction valve means to return to said first position comprise the elasticity of said valve pressing plate means and said valve pressing tongues.

4. A variable delivery compressor according to claim 1, wherein said actuating means comprise a solenoid plunger having electric windings energized and deenergized by said control signal of said control unit, and an iron core placed in said electric windings so as to be axially moved, said iron core having an end fixed to said spool element.

5. A variable delivery compressor according to claim 1, wherein said actuating means comprise a screw element threadedly engaged with said spool means, and a drive motor connected to said screw element for providing said screw element with a rotation, via a rotation transmitting mechanism, said drive motor being connected to said control unit so that said drive motor is operated by said control signal of said control unit, said rotation of said screw element causing axial movement of said spool means.

6. A variable delivery compressor according to claim 1, wherein said compressor is a swash plate type compressor, and wherein said housing means includes at least a rear housing arranged on the rear end side of said cylinder block means, said rear housing having at its central portion said suction chamber in the shape of a round recess and at its outer peripheral portion said delivery chamber in the shape of an annular chamber encircling said suction chamber.

7. A variable delivery compressor according to claim 1, wherein said compressor is a swash plate type compressor, and wherein said housing means includes a front housing arranged on the front end side of said cylinder block means and a rear housing arranged on the rear end side of said cylinder block means, said front housing having at a central portion thereof a first portion of said delivery chamber in the shape of an annular chamber and at an outer peripheral portion thereof a first portion of said suction chamber, said rear housing having at a central portion thereof a second portion of said suction chamber in the shape of a round recess and at an outer peripheral portion thereof a second portion of said delivery chamber in the shape of an annular chamber encirclinq said suction chamber, wherein said spool means, said valve pressing plate means and said permitting means are arranged in said second portion of said suction chamber of said rear housing means, and wherein said reciprocatory compression pistons are double-acting pistons, whereby said swash plate type compressor carries out a full delivery or a reduced delivery operation in response to change in a cooling load of said air-conditioning circuit.

8. A variable delivery compressor according to claim 1, further comprising spring means for always urging said spool means in a direction away from said suction valve means thereby permitting said spool means together with said valve pressing plate means to be separated from said suction valve means when said means for actuating movement of said spool means are deenergized.

9. A variable delivery compressor according to claim 8, wherein said actuating means comprise a first solenoid valve communicatable said pressure chamber of said housing with said delivery flange for applying a high delivery pressure to said spool element thereby moving said spool element toward said suction valve means, a second solenoid valve communicatable said pressure chamber of said housing with said suction flange for applying a low suction pressure to said spool element thereby moving said spool element away from said suction valve means by the action or said spring means, said first and second solenoid valves being operatively connected to said control unit.

10. A variable delivery compressor adapted for use in compressing a refrigerant gas of an air-conditioning circuit of a vehicle comprising:

cylinder block means having therein a plurality of compression chambers in which reciprocatory compression pistons are received, respectively;

housing means having therein a suction chamber from which the refrigerant gas before compression is sucked into the plurality of compression chambers and a delivery chamber into which the compressed refrigerant gas is delivered from the compression chambers;

a valve plate arranged between said cylinder block means and said housing means, and having therein suction ports providing a fluid communication between respective said compression chambers and said suction chamber and delivery ports providing a fluid communication between respective said compression chambers and said delivery chamber;

a suction flange element attached to said cylinder block means, for introducing said refrigerant gas before compression from said air-conditioning circuit into said suction chamber;

a delivery flange element attached to said cylinder block, for delivering said compressed refrigerant gas from said delivery chamber to said air-conditioning circuit;

delivery valve means for closing said delivery ports that provide a fluid communication between said plurality of compression chambers and said delivery chamber, said delivery valve means being opened by said compressed refrigerant gas when delivered from the compression chambers into said delivery chamber;

suction valve means for closing said suction ports that provide a fluid communication between said plurality of compression chambers and said suction chamber, and capable of being opened by said refrigerant gas sucked from the suction chamber into respective said compression chambers;

movable means arranged in said suction chamber and adapted for movement toward and away from said suction valve means, said movable means including a spool element axially slidably mounted in a pressure chamber defined by inner wall means projected inside said housing means;

valve pressing means held by said movable means so as to be moved together with said movable means and adapted for forcibly displacing a predetermined part of said suction valve means from a first position for closing said suction ports of said valve plate to a second position for opening said suction ports when said valve pressing means are moved toward said suction valve means, said valve pressing means including a valve pressing plate attached to an axially inner end of said spool element, and a plurality of valve pressing tongues connected to said valve pressing plate, each said valve pressing tongue being axially extended toward said suction valve means so as to be engaged with said suction valve means when said spool element is moved toward said suction valve means, and respective said plurality of valve pressing tongues having axial lengths different from one another;

means for permitting said predetermined part of said suction valve means which has been forcibly opened by said valve pressing means to return to said first position from said second position in response to movement of said compression pistons toward top dead centers thereof;

a control unit for providing a control signal indicating that a change in a delivery amount of said compressor is needed in response to a change in a cooling load applied to said air-conditioning circuity, and;

means for actuating movement of said movable means toward said suction valve means upon being energized by said control signal of said control unit, said actuating means including a screw element threadedly engaged with said movable means, and a drive motor connected to said screw element for providing said screw element with a rotation, via a rotation transmitting mechanism, said drive motor being connected to said control unit so that said drive motor is operated by said control signal of said control unit, said rotation of said screw element causing axial movement of said movable means.

* * * * *